US006702341B1

(12) United States Patent
Hudelson et al.

(10) Patent No.: US 6,702,341 B1
(45) Date of Patent: Mar. 9, 2004

(54) DOOR OPENING INHIBITING APPARATUS

(76) Inventors: Duane L. Hudelson, 908 E. 62nd St., Sioux Falls, SD (US) 57108; Jerome C. Halvorson, II, 701 N. French Ave., Sioux Falls, SD (US) 57103; Leonard E. Hudelson, 731 S. Prairie Ave., Sioux Falls, SD (US) 57104

( * ) Notice: Subject to any disclaimer, the term of this patent is extended or adjusted under 35 U.S.C. 154(b) by 73 days.

(21) Appl. No.: 10/071,834

(22) Filed: Feb. 6, 2002

Related U.S. Application Data

(63) Continuation-in-part of application No. 09/658,581, filed on Sep. 8, 2000.

(51) Int. Cl.[7] ..... E05C 19/18
(52) U.S. Cl. ..... 292/288; 292/DIG. 17
(58) Field of Search ..... 292/288, 289, 292/292, 295, 342, 343, DIG. 17

(56) References Cited

U.S. PATENT DOCUMENTS 314,105 A * 3/1885 Carnes
485,613 A * 11/1892 Deane
2,586,757 A 2/1952 Wummel et al.
2,993,226 A 7/1961 Baker, Jr. et al.
3,918,121 A * 11/1975 Williams ..... 16/128
3,971,099 A 7/1976 Wallace
5,265,922 A * 11/1993 Falcone ..... 292/258
5,560,080 A * 10/1996 Reed ..... 16/82
5,642,910 A * 7/1997 Betherum ..... 292/288
5,881,431 A 3/1999 Pieper, II et al.
5,984,386 A * 11/1999 Clemens ..... 292/288

* cited by examiner

*Primary Examiner*—Gary Estremsky
(74) *Attorney, Agent, or Firm*—Kaardal & Leonard, LLP

(57) ABSTRACT

A door opening inhibiting apparatus includes a hinge restricting member for mounting on a hinge. The restricting member has first and second ends, lateral sides, and a forward surface for orienting toward a door. The restricting member comprises a mounting portion for mounting on the door hinge, and a pair of wing portions extending laterally outward from the mounting portion. The mounting portion includes a channel for receiving a portion of the barrel of the hinge. The channel opens into the first end of the restricting member and extends from the first end toward the second end of the restricting member. A slot is provided for receiving a portion of the leaves of the hinge when a portion of the barrel is positioned in the channel, and is in communication with the channel. The slot extends from the first end of the restricting member toward the second end.

20 Claims, 9 Drawing Sheets

DOOR OPENING INHIBITING APPARATUS

RELATED APPLICATION

This application is a continuation-in-part of application Ser. No. 09/658,581, filed Sep. 8, 2000.

BACKGROUND OF THE INVENTION

1. Field of the Invention

The present invention relates to security locks for doors and more particularly pertains to a new and portable device designed to enhance an individual's security at home and away from home by allowing the individual to easily and securely secure virtually any door by using the invention to secure the door at the door hinge.

2. Description of the Prior Art

The use of secondary locks for securing doors against unauthorized entry is known in prior art. Specifically, primary and secondary locks whose function is to prevent unauthorized entry through standard and commercial doors have been permanently affixed to the latch side of the door opposite of the door hinges. While providing added security for the door they are affixed to, these devices have a number of drawbacks. One such disadvantage is their lack of portability as they are installed permanently to one door only. Additionally, the initial installation process can be time-consuming and difficult, often requiring the consumer to obtain professional installation which can be expensive. Many of these devices can also be easily overcome by a skilled criminal.

The door opening inhibiting apparatus according to the present invention substantially departs from conventional concepts and designs of prior art, and in doing so, provides an apparatus primarily developed for the purpose of providing the enhanced security of a secondary locking device which is highly portable for carrying on the person and being attached to virtually any door for which the user desires enhanced security. Additionally, it differs from concepts and design in prior art by attaching to the door hinge and applying a clamping force to the door hinge and the adjacent door and door frame to resist unauthorized opening of the door.

SUMMARY OF THE INVENTION

In view of the foregoing disadvantages inherent in the known types of door safety locks, the present invention provides a new door opening inhibiting apparatus wherein the same can be utilized for providing enhanced safety for consumers employing this invention.

To attain this, the present invention generally comprises a hinge restricting member for mounting on a hinge. The restricting member has first and second ends, lateral sides, and a forward surface for orienting toward a door. The restricting member comprises a mounting portion for mounting on the door hinge, and a pair of wing portions extending laterally outward from the mounting portion. The mounting portion includes a channel for receiving a portion of the barrel of the hinge. The channel opens into the first end of the restricting member and extends from the first end toward the second end of the restricting member. A slot is provided for receiving a portion of the leaves of the hinge when a portion of the barrel is positioned in the channel, and is in communication with the channel. The slot extends from the first end of the restricting member toward the second end.

This new invention successfully provides secondary security to its user which is portable, easily installed, and removed, and in a very cost-effective manner.

There has thus been outlined, rather broadly, the more important features of the invention in order that the detailed description thereof that follows may be clearly understood, and in order that the present contribution to the art may be better appreciated. These and additional features of the invention will be described hereinafter and will form the subject matter of the claims appended hereto.

In this respect, before explaining at least one embodiment of the invention in detail, it is understood that the invention is not limited in its application to the details of construction set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate the conception, upon which the disclosure is based, may readily be utilized as a basis of designing other structures for carrying out portable door security employing the invention of the present invention. It is important, therefore, that the claims be regarded as including such equivalent constructions insofar as they do not depart from the spirit and scope of the present invention.

The use of the invention provides additional resistance to unauthorized entry through a door in addition to the primary locking structure of the door. The apparatus is in a form that is sufficiently compact and portable to permit carrying in the shirt pocket or jacket pocket or purse of the user, attachment to a wide variety of door hinges, and removal from the door hinge without any damage or marking of the door.

The invention thus provides a cost-effective alternative to expensive and difficult to install security locks presently available.

These, together with other objects of the invention, along with the various features of novelty which characterize the invention, are pointed out with particularity in the claims annexed to and forming part of this disclosure. For a better understanding of the invention, its operation advantages and the specific objects obtained by its uses, reference should be made to the accompanying drawings and descriptive matter in which there are preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
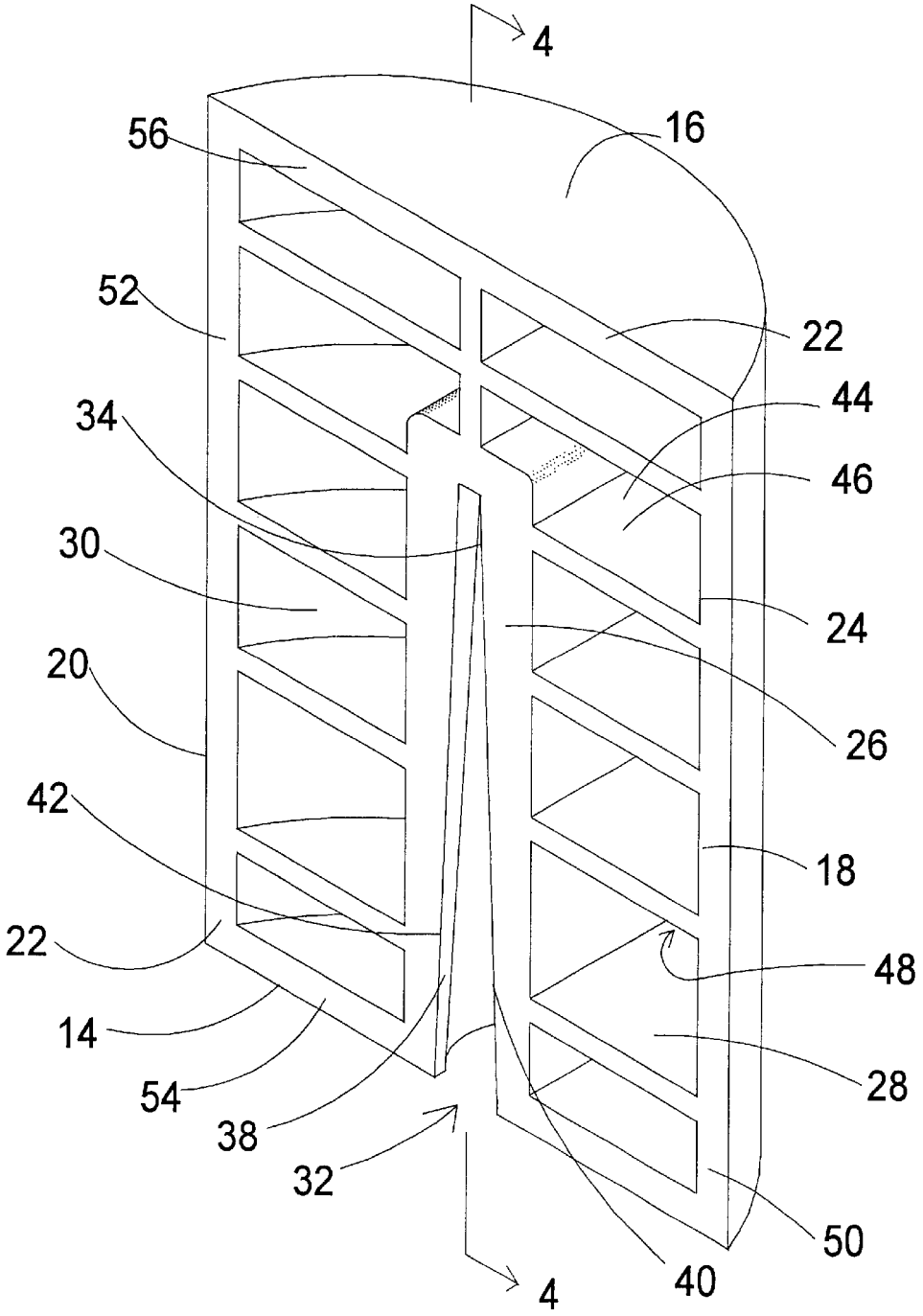
FIG. 1 is a schematic perspective view of a new door opening inhibiting apparatus according to the present invention.
Figure 2:
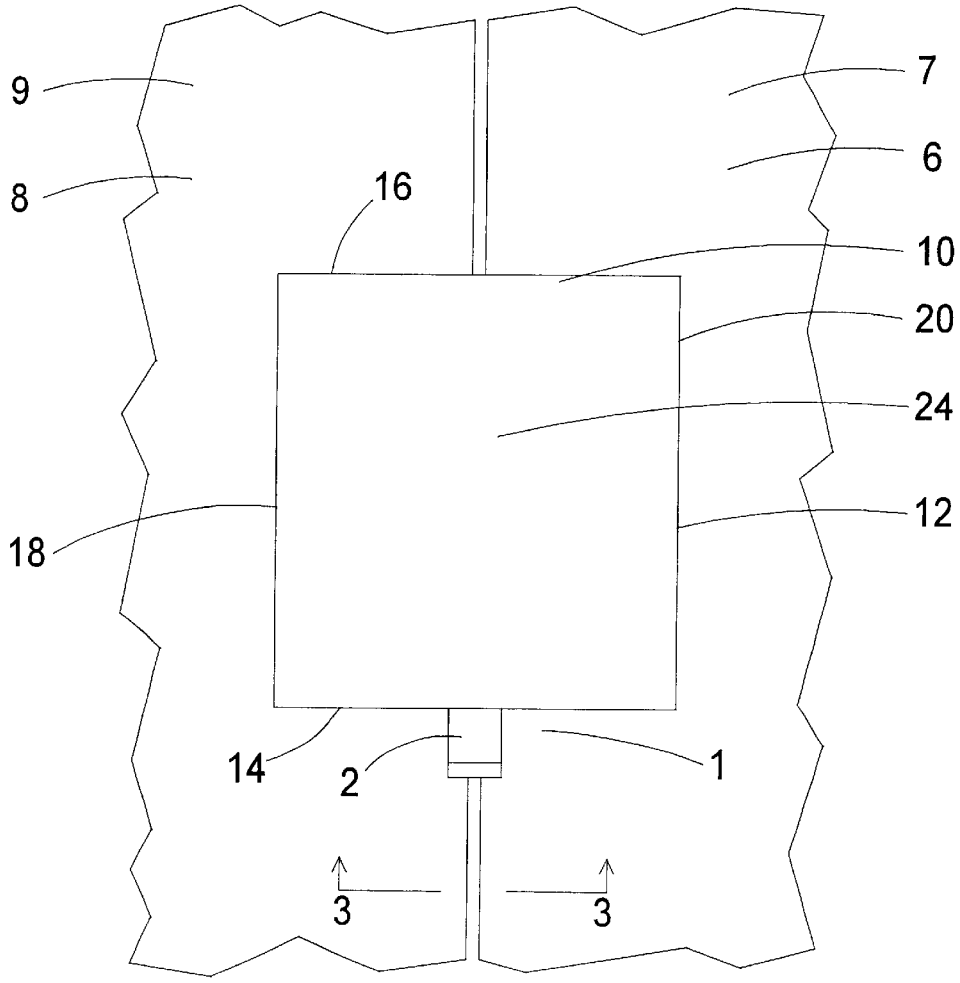
FIG. 2 is a schematic rear view of the present invention.
Figure 3:
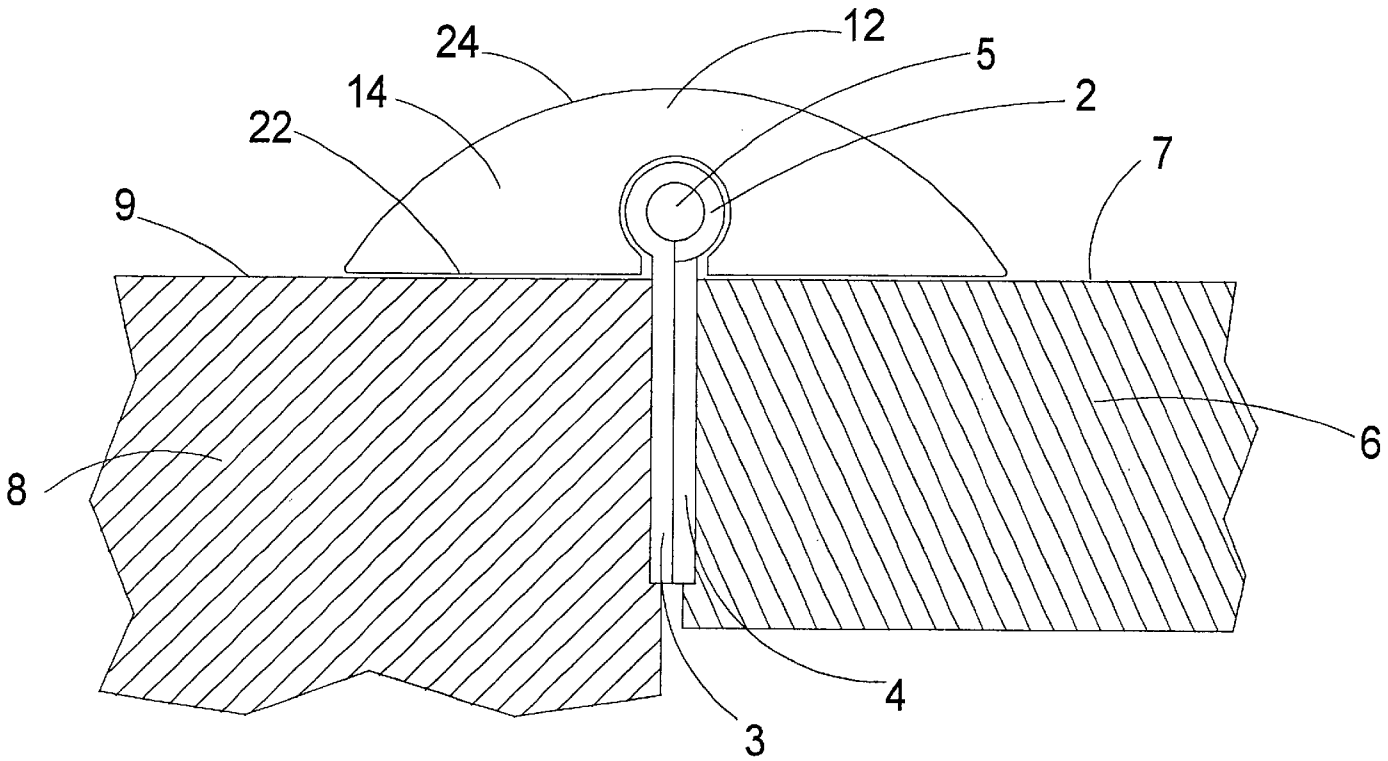
FIG. 3 is a schematic bottom view of the present invention taken from the perspective of line 3—3 in FIG. 2.
Figure 4:
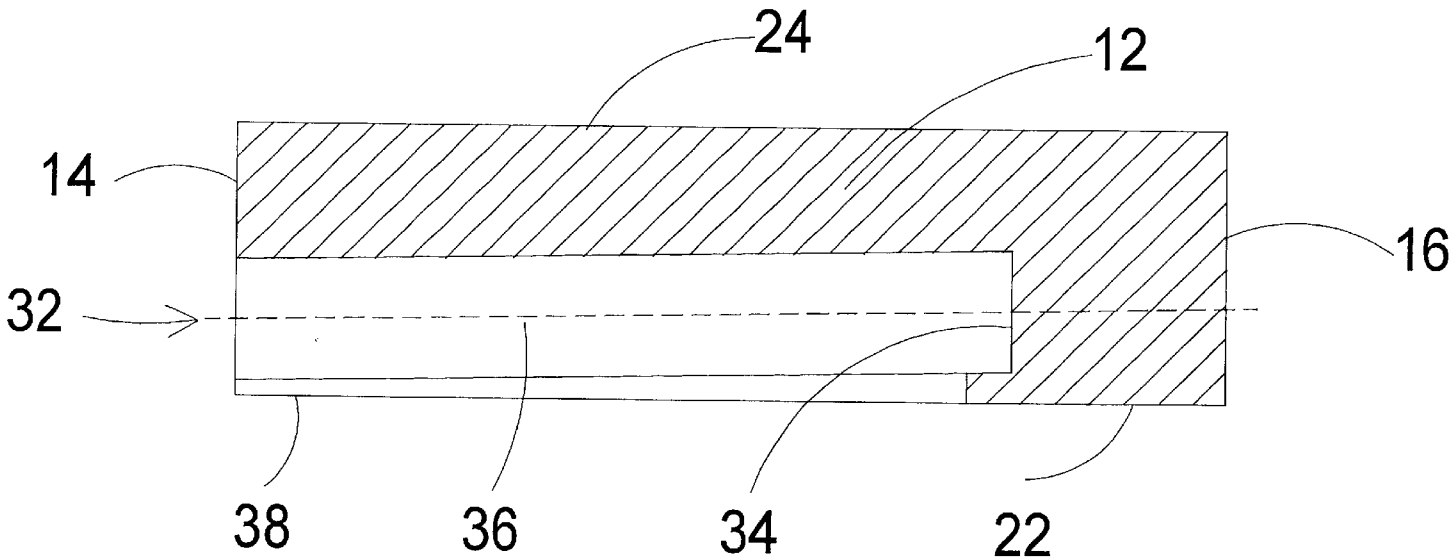
FIG. 4 is a schematic cross sectional view of the present invention taken along line 4—4 of FIG. 1.
Figure 5:
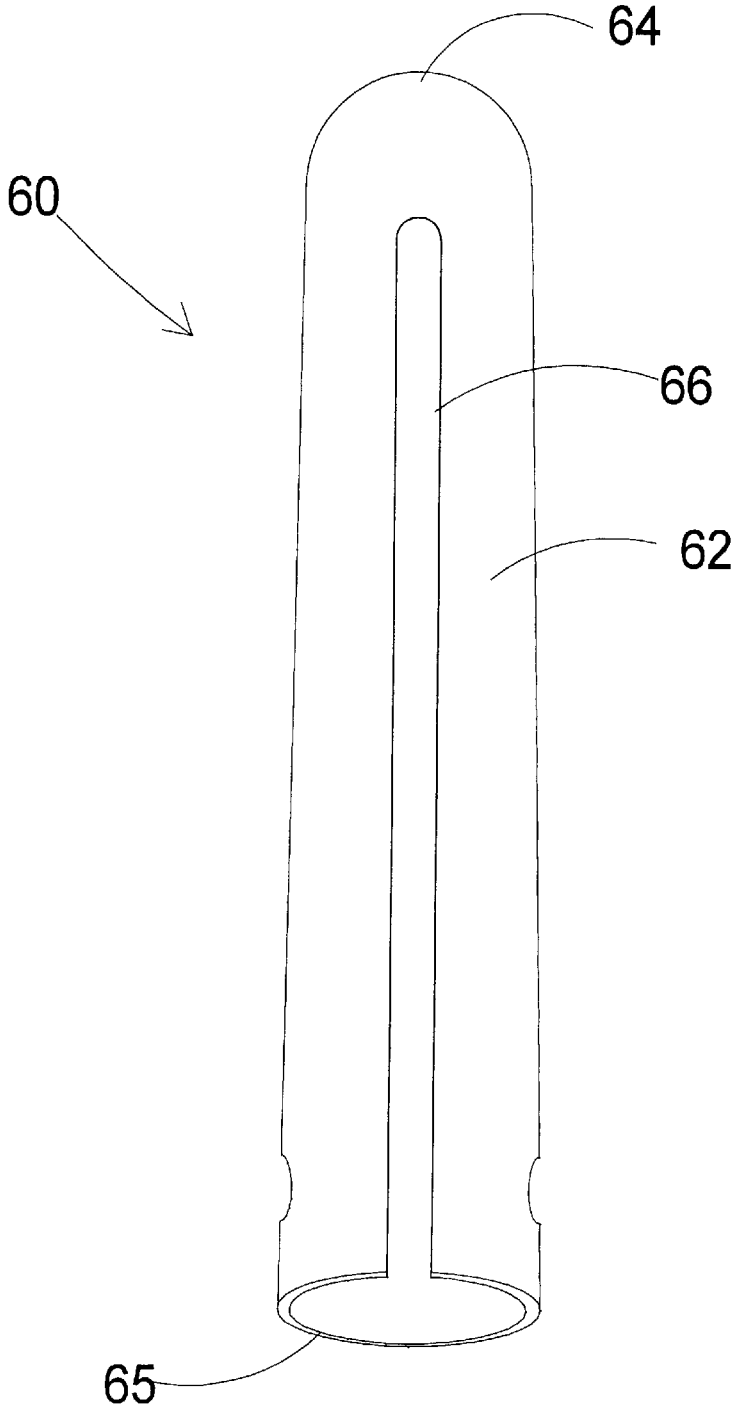
FIG. 5 is a schematic front view of a second embodiment of the present invention.
Figure 6:
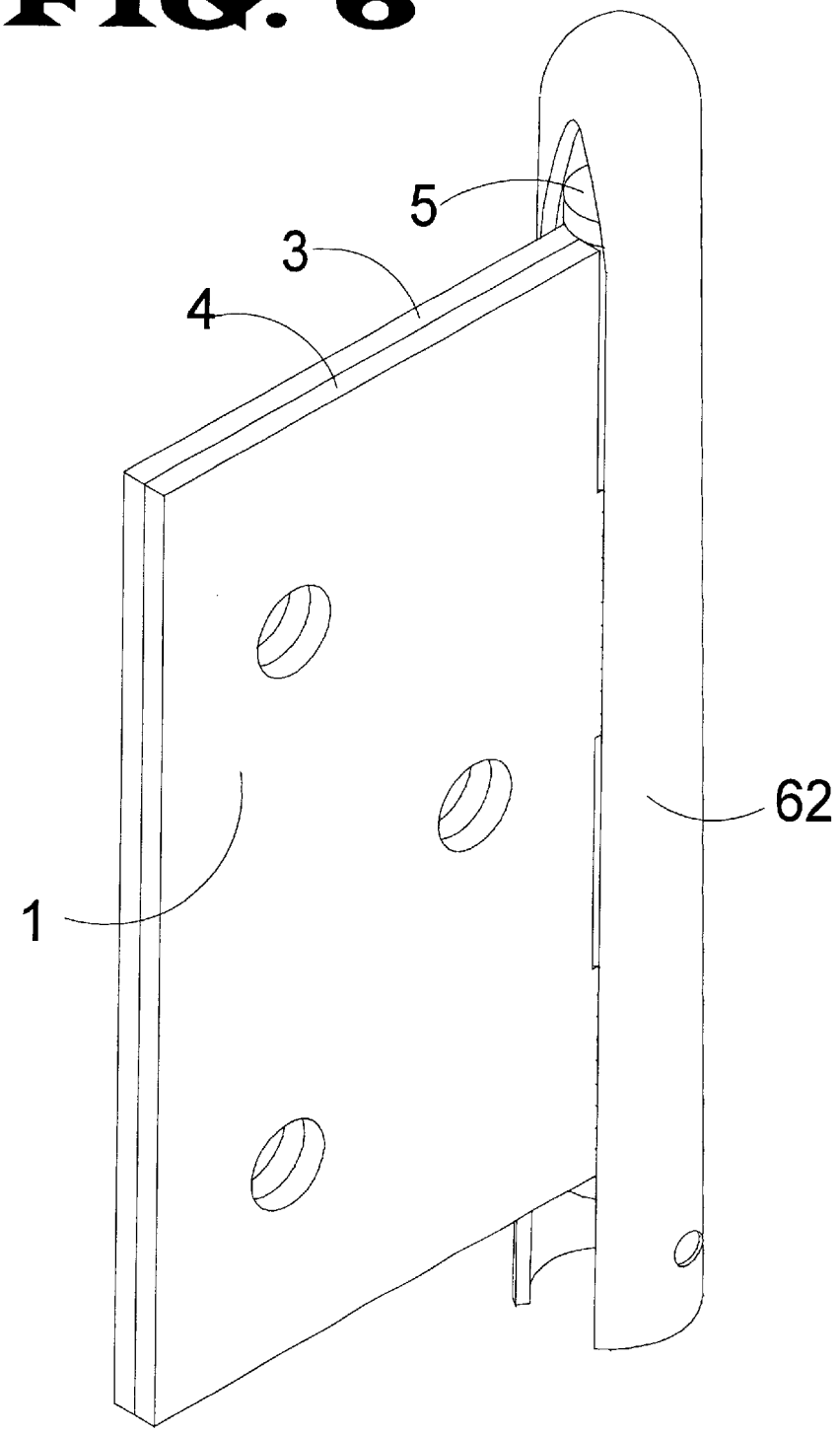
FIG. 6 is a schematic perspective view of the second embodiment of the present invention shown mounted on a hinge.
Figure 7:
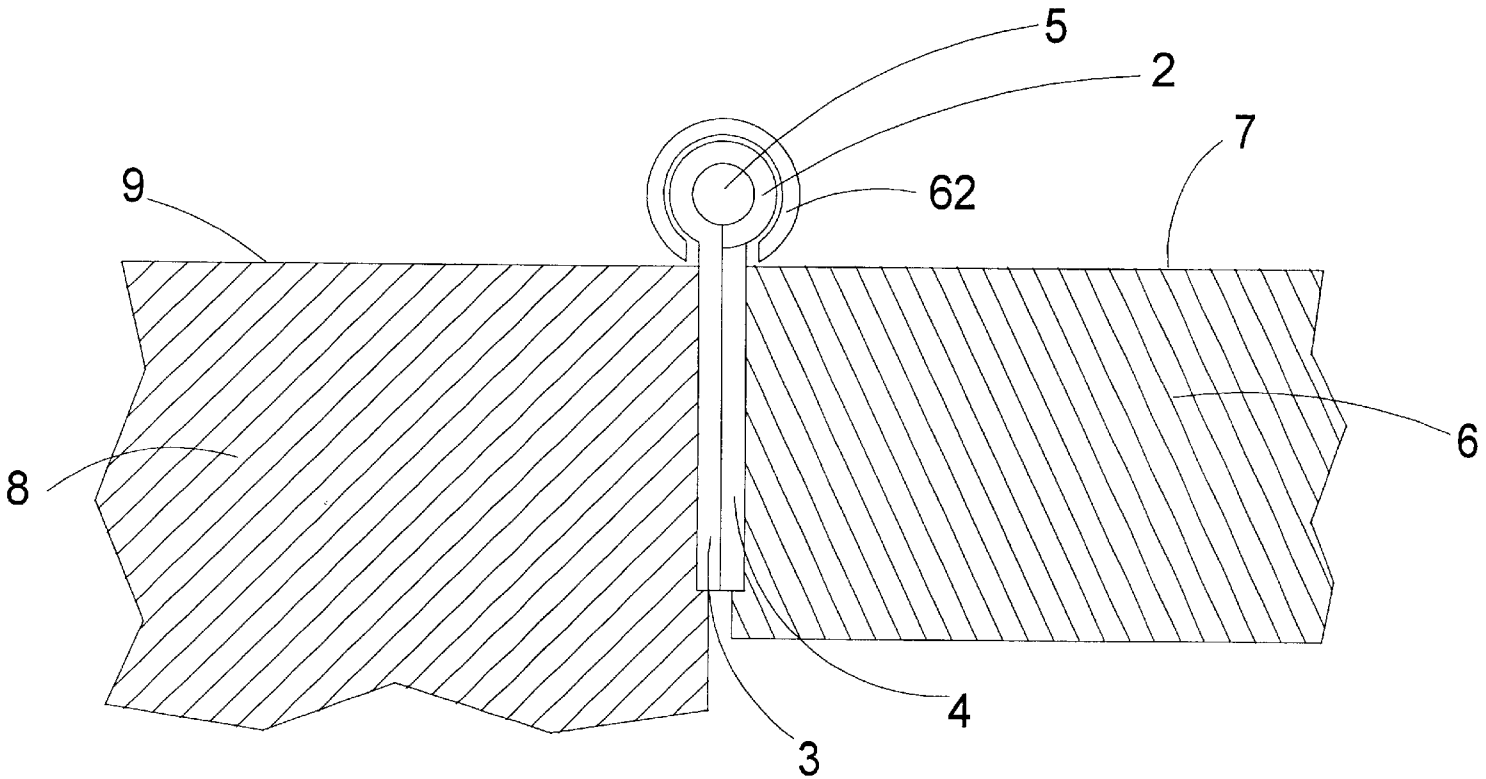
FIG. 7 is a schematic top view of the second embodiment of the present invention.
Figure 8:
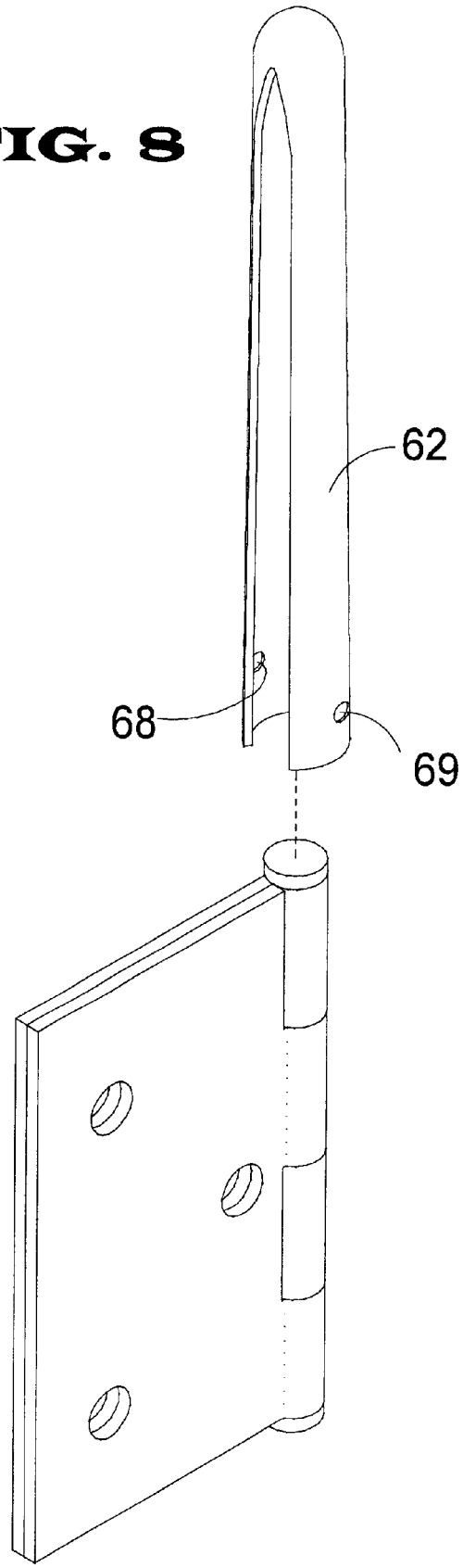
FIG. 8 is a schematic perspective view of the second embodiment of the present invention shown in position for mounting on a hinge.

With reference now to the drawings, and in particular to FIGS. 1 through 9 thereof, a new door opening inhibiting apparatus embodying the principles and concepts of the present invention will be described.

As best illustrated in FIGS. 1 through 4 and 9, a first embodiment of the door opening inhibiting apparatus 10 of the invention is highly suitable for use with a door hinge 1 having a barrel 2 and a pair of leaves 3, 4 that extend from the barrel and are pivotable with respect to each other. Typically, the barrel 2 is comprised of annular extensions of the leaves that are interlinked together by a pin 5 to form the barrel. The hinge has a closed condition in which the leaves 3, 4 are positioned adjacent to each other, and the hinge also has an open condition in which the leaves are pivoted away from the adjacent positions. The hinge 1 is typically mounted on and generally between a door 6 having an inner surface 7 and a door jamb or frame 8 having an inner surface 9.

The device 10 may comprise a hinge restricting member 12 for mounting on the hinge 2. The hinge restricting member 12 may have first 14 and second 16 ends, and may have lateral sides 18, 20. The hinge restricting member 12 may include a front with a forward surface 22 for orienting toward the inner surfaces of the door and the door jamb, and a rear with a rearward surface 24 for orienting away from the door and door jamb.

In a broader sense, the hinge restricting member 12 includes a mounting portion 26 and a pair of wing portions 28, 30 that extend laterally outward from the mounting portion 26. The mounting portion 22 is adapted for mounting on the hinge 1, and may receive a portion of the barrel 2 and the leaves 3, 4 of the hinge. A portion of the forward surface 22 of the hinge restricting member may be located on the mounting portion 26.

The mounting portion 26 may include a channel 32 for receiving a portion of the barrel 2 of the hinge 1. The channel 32 opens into the first end 14 of the hinge restricting member, and extends from the first end toward the second end 16 of the hinge restricting member. The channel 32 may have a blind end 34 that is located between the first 14 and second 16 ends, and may be located between a midpoint between the ends 14, 16 and the second end 16. The channel 32 may have a central longitudinal axis 36. In one preferred embodiment of the invention, the central longitudinal axis 36 of the channel is relatively closer to the forward surface 22 of the hinge restricting member toward the first end 14 thereof and is relatively farther from the forward surface toward the second end 16, so that the channel is closer to the forward surface at the first end than at the blind end 34. Advantageously, this angled characteristic of the channel serves to move the forward surface 22 of the hinge restricting member toward the inner surfaces of the door and door jamb as the barrel 2 of the hinge 1 is moved further into the channel 32. This movement toward the door surface can serve to adjust the fit of the hinge restricting member to hinges having a variety of distances between the barrel and the door surface, and permit a portion of the hinge restricting member to be snugly wedged between the barrel of the hinge and the door surface. Illustratively, the angle between the plane of the forward surface 22 and the central longitudinal axis 26 is between approximately 1 degree and 5 degrees, and in one preferred embodiment the angle is approximately 2 degrees.

The channel 32 may have a substantially circular cross sectional shape for receiving the generally cylindrical shape of most barrels of hinges. The channel 32 may have a diameter, and the diameter may be substantially uniform along the length of the channel. In one preferred embodiment of the invention, the diameter of the substantially circular channel is greater than a distance between the central longitudinal axis 36 of the channel and the forward surface 22 of the hinge restricting member such that the channel intersects or passes through the forward surface and the channel therefore is not a complete cylinder, but a partial cylinder that intersects but does not extend beyond the forward surface 22.

The intersection of the channel 32 with the forward surface 22 of the hinge restricting member forms a slot 38 for receiving a portion of the leaves 3, 4 of the hinge when a portion of the barrel 2 is positioned in the channel. The slot 38 is thus in communication with the channel 32. The slot 38 may extend from the first end 14 of the hinge restricting member 12 toward the second end 16 of the member 12. In one preferred embodiment of the invention, the slot is relatively wider (in a direction extending between the lateral sides 18, 20 of the member 12) at the first end 14 and is relatively narrower toward the second end 16. The slot 38 may be defined by a pair of edges 40, 42, and the edges 40, 42 may diverge toward the first end 14 and converge toward the second end 16. Advantageously, the converging edges 40, 42 tend to pinch the leaves 3, 4 of the hinge 1 together as the leaves are moved further into the slot.

The pair of wing portions 28, 30, which extend laterally outward from the mounting portion 26, may extend from the mounting portion in substantially opposite directions. Each of the wing portions 28, 30 may form a portion of the forward surface 22 of the hinge restricting member. In one preferred embodiment, the portions of the forward surface 22 on the wing portions all lie in a substantially common plane with each other, although this is not a critical requirement of the invention.

In greater detail, the forward surface 22 of the hinge restricting member 12 may be substantially planar for facilitating the ability of the forward surface to abut against the inner surfaces of the door and jamb door. In one embodiment of the invention, the forward surface 22 may have a plurality of recesses 44 that are formed therein to define a plurality of ribs 46 extending from the lateral sides 18, 20 of the hinge restricting member 12 toward a middle of the hinge restricting member between the lateral sides, and thus the forward surface is not necessarily continuous.

In one embodiment of the invention, the rearward surface 24 of the hinge restricting member 12 is curved between the lateral sides 18, 20 and is substantially straight between the ends 14, 16. In this embodiment, a thickness of the hinge restricting member 12 is relatively thicker at a middle location between the lateral sides 18, 20 and tapers thinner toward the lateral sides. The hinge restricting member 12 may include a rear wall 48 that is substantially continuous between the lateral sides 18, 20. The rear wall 48 may have lateral edges 50, 52 that are positioned at the lateral sides 18, 20 of the hinge restricting member. The rear wall 48 may comprise a portion of a cylindrical wall that arcs between the lateral sides 18, 20. The hinge restricting member 12 may also have a pair of end walls 54, 56 that are positioned at the ends 14, 16 of the hinge restricting member. Each of the ends walls 54, 56 may comprise a portion of a circle.

Optionally, a vent hole or passage may extend from the blind end 34 of the channel 32 to the rearward surface 24 or the exterior surface of the end wall 56 to alleviate any vacuum that might form between the upper end of the barrel 2 of the door hinge 1 and the blind end 34 of the channel 32 to facilitate removal of the device from the hinge 1.

Illustratively, the device may be formed of a glass filled polycarbonate material for a suitable combination of strength, low weight and economy of cost, although other materials, including woods, metals, and composites may be used. In one embodiment of the invention, the width of the device between the lateral sides is approximately 8 cm (approximately 3.8 inches), and the length between the ends is approximately 13 centimeters (approximately 5 inches). Illustratively, the device may have a maximum thickness of approximately 2.8 centimeters (slightly more than approximately 1 inch), and a radius of curvature of the rearward surface is approximately 5.5 centimeters (slightly more than approximately 2 inches). In one preferred embodiment, the channel has a diameter of approximately 1.5 centimeters (approximately 0.6 inches).

In the use of the invention, a door to which the invention is to be applied is moved into a closed or substantially closed position. At least an upper portion of the barrel of the hinge is moved into the channel in a downward movement of the device 10, with a portion of the leaves moving into the slot. The device may be permitted to move downwardly over the barrel to a position where further movement of the device in a downward direction is resisted by resistance of the barrel to move further into the channel, or by the forward surface of the device coming into contact with the inner surface of the door and/or the inner surface of the door jamb. Only a somewhat snug fit is required, and the barrel of the hinge does not have to be completely moved into the channel for the device to be effective for resisting opening of the door.

The device 10 restricts or inhibits the opening of a door in at least two ways, including restricting operation of the door hinge by pinching or clamping the leaves together to bias the leaves into a closed position of the hinge by the edges of the device defining the slot. Additionally, the wing portions of the device tend to resist movement of the inner surface of the door toward the inner surface of the door jamb as the hinge moves from the closed position toward the open position. The device 10 may also directly bear against the inner surface of the door and the inner surface of the door jamb to resist movement of the door toward the door jamb. Any attempt to pivot the door from a substantially closed position toward an open position presses the inner surface of the door against the forward surface on one of the wing portions, and against an edge of the rear wall. This force may be transferred through the curved rear wall and presses the other of the edges of the rear wall and to the inner surface of the door jamb. The structure of the device resists the compression of the rear wall between the inner surfaces of the door and the door jamb, and tends to resist further opening of the door.

Significantly, the angling of the channel 32 with respect to the forward surface 22 of the hinge restricting member 12 can permit the channel to be made relatively large (in a plane transverse to the central longitudinal axis) to accept relatively large barrel sizes therein, while the hinge restricting member is still able to be effectively wedged between the barrel and the surface of the door. Also, the gradual narrowing of the slot 38 permits hinge leaves of various sizes (e.g., thicknesses) to be accepted into the slot, with relatively thinner hinge leaves being movable further into the slot than relatively thicker hinge leaves. It should be noted that the hinge barrel need not be fully inserted into the channel, nor the hinge leaves be fully inserted into the slot, for the hinge restricting member to become sufficiently wedged between the barrel and the door surface, and the hinge leaves to become sufficiently wedged between the edges 40, 42 of the slot, for the hinge restricting member to be effective at resisting the opening of the door.

Figure 9:
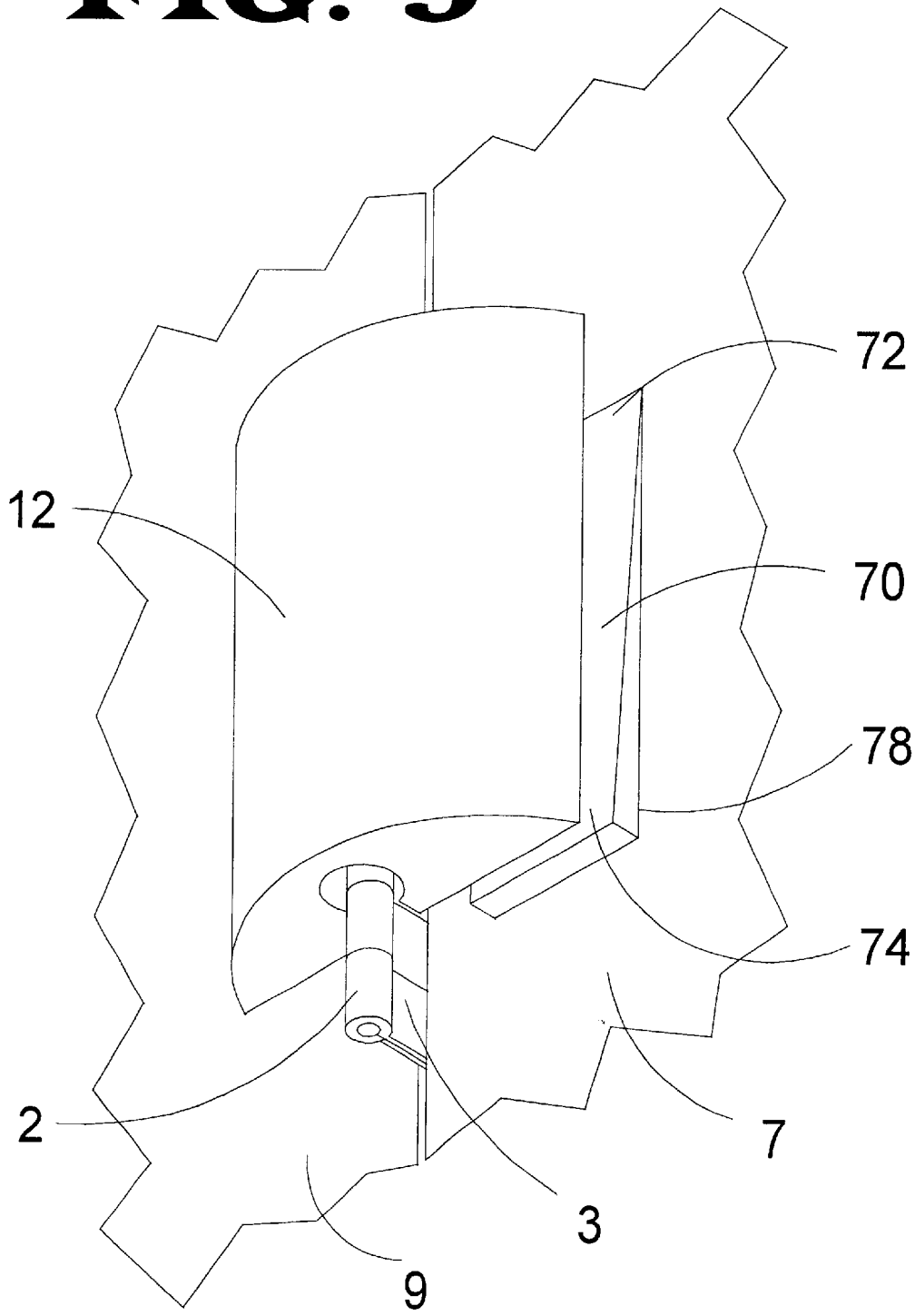
FIG. 9 is a schematic perspective view of an optional wedge member of the present invention shown positioned between the hinge restricting member and the inner surface of the door.

As an optional feature of the invention is a wedge member 70 that may be used in conjunction with the hinge restricting member 12 (see FIG. 9). The wedge member may be used, for example, in situations where there is a significant differential between the plane of the inner surface of door and the plane of the inner surface of the door jamb, such as may occur when the walls of the building structure are relatively thick and the door is somewhat inset. The wedge member may be elongate with a relatively thinner end 72 and a relatively thicker end 74, and a substantially gradual thickening of the wedge member from the thinner end 72 to the thicker end 74. The wedge member may be mounted on the inner surface which is inset with respect to the other, such as the surface of the door. In one embodiment of the invention, one face 78 of the wedge member may have an adhesive applied thereon for adhering the wedge member to the surface in a relatively permanent mounting. The wedge member 70 should be positioned on the surface such that as the hinge barrel moves into the channel 32, a portion of the forward surface 22 of the hinge restricting member 12 contacts and moves along a face of the wedge from the thinner end 72 toward the thicker end 74. The wedge member 70 thus tends to move the forward surface 22 of the hinge restricting member 12 away from the inner surface on which the wedge member is mounted.

A second embodiment of the invention is shown in FIGS. 5 through 8 of the drawings. The door safety lock 60 is generally comprised of a cylindrically shaped housing 62 of hollow design, closed at one end 64, with a slot 66 in one side of the housing, and of sufficient length to encompass the hinge-pin of the typical residential or commercial door hinge.

The door safety lock 60 is most suitably employed on a typical swinging door which utilizes the common butterfly style hinge, although other applications of the invention may also be envisioned by those skilled in the art. Such applications include hinges where pivot points are used to create joints, where that pivot point allows moving parts to travel in different directions simultaneously and/or where one part remains stationary and a second part moves at a pivot point. One such application is in the heavy equipment industry.

In this embodiment of the invention, the door safety lock housing 62 has an internal diameter which may be determined by the diameter of a range of typical hinge-pins for which the housing is designed to encompass. Additionally, the width of the slot 66 may be determined by the width of a range of typical hinge plates when the hinge plates are in the closed position. Both dimensions must be sufficient to allow for easy installation and removal, yet of close enough tolerance to provide the security of the required clamping force to prevent the hinge from opening. The determining factor for the outer dimensions of the housing is such that the overall size of the housing allows it to be installed and removed from a hinge that is in place on a working door. In one preferred embodiment, one end 64 of the housing 62 of the door safety lock 60 is closed to prevent the hinge from sliding through the housing to keep the hinge in the closed position.

Optionally, a pair of apertures 68, 69 may be formed in the housing 62 toward the open end 65 of the housing permits a shackle bar of a padlock or other locking means to be passed through the aperture. When the hinge is inserted into the housing, the shackle or other bar may be passed through the apertures to prevent the hinge from being with drawn from the slot and interior of the housing until the shackle or bar is removed from the apertures of the housing.

A significant feature of this invention is the portability and this embodiment of the present invention would be of a size that could easily be carried by the user from location to location. However, it will be appreciated by those skilled in the art that other configurations might be employed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

We claim:

1. A device for restricting the operation of a door hinge having a barrel and a pair of leaves extending from the barrel and being pivotable with respect to each other, the device comprising:

a hinge restricting member for mounting on a hinge, the hinge restricting member having first and second ends and lateral sides, the hinge restricting member having a forward surface for orienting toward a door, the hinge restricting member comprising:

a mounting portion for receiving a portion of the barrel and leaves of the door hinge, the mounting portion including:

a channel formed therein for receiving a portion of the barrel of the hinge, the channel opening into the first end of the hinge restricting member and extending from the first end toward the second end of the hinge restricting member; and a slot for receiving a portion of the leaves of the hinge when a portion of the barrel is positioned in the channel, the slot being in communication with the channel, the slot extending from the first end of the hinge restricting member toward the second end; and a pair of wing portions extending laterally outward from the mounting portion;

wherein the channel has a central longitudinal axis, the central longitudinal axis of the channel moving away from the forward surface of the hinge restricting member as the channel extends from the first end of the hinge restricting member toward the second end of the hinge restricting member;

wherein the forward surface having a plurality of recesses formed therein to define a plurality of ribs extending from the lateral sides of the hinge restricting member toward a middle of the hinge restricting member.

2. The device of claim 1 wherein the channel has a blind end between the first and second ends.

3. The device of claim 1 wherein the forward surface has a width and length.

4. A device for restricting the operation of a door hinge having a barrel and a pair of leaves extending from the barrel and being pivotable with respect to each other, the device comprising:

a hinge restricting member for mounting on a hinge, the hinge restricting member having first and second ends and lateral sides, the hinge restricting member having a forward surface for orienting toward a door, the hinge restricting member comprising:

a mounting portion for receiving a portion of the barrel and leaves of the door hinge, the mounting portion including:

a channel formed therein for receiving a portion of the barrel of the hinge, the channel opening into the first end of the hinge restricting member and extending from the first end toward the second end of the hinge restricting member; and a slot for receiving a portion of the leaves of the hinge when a portion of the barrel is positioned in the channel, the slot being in communication with the channel, the slot extending from the first end of the hinge restricting member toward the second end; and a pair of wing portions extending laterally outward from the mounting portion;

wherein the channel has a blind end between the first and second ends.

5. The device of claim 4 wherein the blind end being located between a midpoint between the ends and the second end.

6. The device of claim 4 wherein the channel has a central longitudinal axis, the central longitudinal axis of the channel moving away from the forward surface of the hinge restricting member as the channel extends from the first end of the hinge restricting member toward the second end of the hinge restricting member.

7. A device for restricting the operation of a door hinge having a barrel and a pair of leaves extending from the barrel and being pivotable with respect to each other, the device comprising:

a hinge restricting member for mounting on a hinge, the hinge restricting member having first and second ends and lateral sides, the hinge restricting member having a forward surface for orienting toward a door, the hinge restricting member comprising:

a mounting portion for receiving a portion of the barrel and leaves of the door hinge, the mounting portion including:

a channel formed therein for receiving a portion of the barrel of the hinge, the channel opening into the first end of the hinge restricting member and extending from the first end toward the second end of the hinge restricting member; and a slot for receiving a portion of the leaves of the hinge when a portion of the barrel is positioned in the channel, the slot being in communication with the channel, the slot extending from the first end of the hinge restricting member toward the second end; and a pair of wing portions extending laterally outward from the mounting portion;

wherein a thickness of the hinge restricting member is relatively thicker at a middle between the lateral sides and tapering thinner toward the lateral sides.

8. The device of claim 7 wherein the central longitudinal axis of the channel is relatively closer to the forward surface of the hinge restricting member at the first end of the hinge restricting member and is relatively farther apart from the forward surface at a location spaced from the first end toward the second end.

9. The device of claim 7 wherein the channel has a substantially circular cross sectional shape, a diameter of the substantially circular channel being greater than a distance between the central longitudinal axis and the forward surface of the hinge restricting member.

10. The device of claim 7 wherein the slot is relatively wider at the first end and being relatively narrower toward the second end.

11. The device of claim 7 wherein the slot is defined by a pair of edges, the edges diverging toward the first end of the hinge restricting member and converging toward the second end of the hinge restricting member.

12. The device of claim 7 wherein the pair of wings extend in substantially opposite directions from the mounting portion.

13. The device of claim 7 wherein each of the wing portions has a portion of the forward surface of the hinge restricting member.

14. The device of claim 13 wherein the portions of the forward surface on the wing portions lie in a substantially common plane.

15. The device of claim 7 wherein the forward surface is substantially planar.

16. The device of claim 7 wherein the forward surface having a plurality of recesses formed therein to define a plurality of ribs extending from the lateral sides of the hinge restricting member toward a middle of the hinge restricting member.

17. The device of claim 7 wherein the hinge restricting member has a rearward surface, the rearward surface being curved between the lateral sides and being substantially straight between the ends.

18. The device of claim 7 wherein the hinge restricting member has a rear wall being substantially continuous between the lateral sides, the rear wall having lateral edges positioned at the lateral sides of the hinge restricting member.

19. A device for restricting the operation of a door hinge having a barrel and a pair of leaves extending from the barrel and being pivotable with respect to each other, the device comprising:

a hinge restricting member for mounting on a hinge, the hinge restricting member having first and second ends and lateral sides, the hinge restricting member having a forward surface for orienting toward a door, the hinge restricting member comprising:

a mounting portion for receiving a portion of the barrel and leaves of the door hinge, the mounting portion including:

a channel formed therein for receiving a portion of the barrel of the hinge, the channel opening into the first end of the hinge restricting member and extending from the first end toward the second end of the hinge restricting member; and a slot for receiving a portion of the leaves of the hinge when a portion of the barrel is positioned in the channel, the slot being in communication with the channel, the slot extending from the first end of the hinge restricting member toward the second end; and a pair of wing portions extending laterally outward from the mounting portion;

wherein the hinge restricting member has a rear wall being substantially continuous between the lateral sides, the rear wall having lateral edges positioned at the lateral sides of the hinge restricting member;

wherein the hinge restricting member has a pair of end walls positioned at the ends of the hinge restricting member.

20. A device for restricting the operation of a door hinge having a barrel and a pair of leaves extending from the barrel and being pivotable with respect to each other, the device comprising:

a hinge restricting member for mounting on a hinge, the hinge restricting member having first and second ends, the hinge restricting member having lateral sides, the hinge restricting member having a forward surface for orienting toward a door, the forward surface being substantially planar, the forward surface having a plurality of recesses formed therein to define a plurality of ribs extending from the lateral sides of the hinge restricting member toward a middle of the hinge restricting member, the hinge restricting member having a rearward surface, the rearward surface being curved between the lateral sides and being substantially straight between the ends, a thickness of the hinge restricting member being relatively thicker at a middle between the lateral sides and tapering thinner toward the lateral sides, the hinge restricting member having a rear wall being substantially continuous between the lateral sides, the rear wall having lateral edges positioned at the lateral sides of the hinge restricting member, the rear wall comprising a portion of a cylindrical wall, the hinge restricting member having a pair of end walls positioned at the ends of the hinge restricting member, each of the ends walls comprising a portion of a circle, the hinge restricting member comprising:

a mounting portion for receiving a portion of the barrel and leaves of the door hinge, a portion of the forward surface of the hinge restricting member being located on the mounting portion, the mounting portion including:

a channel formed therein for receiving a portion of the barrel of the hinge, the channel opening into the first end of the hinge restricting member and extending from the first end toward the second end of the hinge restricting member, the channel having a blind end between the first and second ends, the blind end being located between a midpoint between the ends and the second end, the channel having a central longitudinal axis, the central longitudinal axis of the channel being relatively closer to the forward surface of the hinge restricting member toward the first end of the hinge restricting member and being relatively farther from the forward surface toward the second end, the channel having a substantially circular cross sectional shape, a diameter of the substantially circular channel being greater than a distance between the central longitudinal axis and the forward surface of the hinge restricting member; and a slot for receiving a portion of the leaves of the hinge when a portion of the barrel is positioned in the channel, the slot being in communication with the channel, the slot extending from the first end of the hinge restricting member toward the second end, the slot being relatively wider at the first end and being relatively narrower toward the second end, the slot being defined by a pair of edges, the edges diverging toward the first end and converging toward the second end;

a pair of wing portions extending laterally outward from the mounting portion, the pair of wings extending in substantially opposite directions from the mounting portion, each of the wing portions having a portion of the forward surface of the hinge restricting member, the portions of the forward surface on the wing portions lying in a substantially common plane.

* * * * *